United States Patent [19]

van Laar et al.

[11] 4,398,999

[45] Aug. 16, 1983

[54] COKE-OVEN BATTERY HAVING TIE COOKING MEMBERS

[75] Inventors: Jacobus van Laar, Santpoort; Timen Vander, Ursem; Johannes A. Kroes, Amsterdam; Pieter G. Broersen, Lisse, all of Netherlands

[73] Assignee: Estel Hoogovens BV, Netherlands

[21] Appl. No.: 341,269

[22] Filed: Jan. 21, 1982

[30] Foreign Application Priority Data

Jan. 21, 1981 [NL] Netherlands ..... 8100261

[51] Int. Cl.[3] ..... C10B 29/00; C10B 29/04; C10B 29/08

[52] U.S. Cl. ..... 202/267 R; 52/227; 110/336; 202/268; 202/270; 432/238

[58] Field of Search ..... 202/82, 96, 113, 222, 202/224, 239, 267 R, 268, 270; 432/238; 110/336; 52/227, 249, 269

[56] References Cited

U.S. PATENT DOCUMENTS

| | | | |
|---|---|---|---|
| 2,199,510 | 5/1940 | Otto | 202/268 |
| 2,338,618 | 1/1944 | Becker | 202/270 |
| 3,054,730 | 9/1962 | Willeke | 202/268 |
| 3,190,818 | 6/1965 | Otto | 202/268 |
| 3,197,385 | 7/1965 | Wethly | 202/268 |
| 3,247,079 | 4/1966 | Wethly | 202/268 |

FOREIGN PATENT DOCUMENTS

| | | |
|---|---|---|
| 231043 | 4/1910 | Fed. Rep. of Germany . |
| 971368 | 1/1959 | Fed. Rep. of Germany . |
| 1263684 | 3/1968 | Fed. Rep. of Germany . |
| 2709631 | 9/1978 | Fed. Rep. of Germany . |
| 2752876 | 5/1979 | Fed. Rep. of Germany . |
| 428268 | 5/1935 | United Kingdom . |
| 667566 | 3/1952 | United Kingdom . |

*Primary Examiner*—Bradley Garris

*Attorney, Agent, or Firm*—Stevens, Davis, Miller & Mosher

[57] ABSTRACT

A coke oven battery has a continuous roof and uprights at each of the pusher and coke sides. The uprights are connected by ties extending through pipes embedded in the roof. To provide cooling for the ties, a massive metal cooling member extends upwardly from each pipe to the upper side of the roof, to conduct heat away from the pipe. The cooling member may contain a chamber forming an evaporation cooling system.

6 Claims, 4 Drawing Figures

COKE-OVEN BATTERY HAVING TIE COOKING MEMBERS

BACKGROUND OF THE INVENTION

1. Field of the Invention

The invention relates to a coke-oven battery of the type having a continuous oven roof and a plurality of uprights on the so-called machine or pusher side and on the coke side of the battery. These uprights are linked together by means of ties, e.g. tie-bolts, arranged inside pipes installed in the oven roof.

2. Description of the Prior Art

In the structure of a coke-oven battery described above, the uprights and ties form a frame, typically of steel, which supports the refractory structure of coking chamber, combustion chambers and heat regenerators. The ties are typically tie-bolts.

Because, as the temperature of the structure changes, different degrees of expansion occur in the frame and the refractory structure, it is conventional for the tie-bolts to be prestressed using resilient elements to ensure that the refractory structure remains intact under pressure. The freedom of movement relative to the oven-roof structure which the ties need for this purpose makes it advisable for the ties to be arranged inside pipes in the roof. For this purpose, the ties are generally recessed into the oven roof, which is around 1 to 1½ m thick, at a depth for example about 100 mm from the top of the roof.

In order to ensure maintenance of the pre-stress of the tie bolts it is necessary to check the tension in the ties at regular intervals and where necessary to correct it. In view of the large number of ties and their inaccessibility, considerable difficulties are encountered in carrying out sufficiently regular checks on these tension values. In addition to this, the temperature in the ties may increase considerably in a very short time as a result of leakages through the oven roof or flames shooting out when the coking chambers are opened. These factors may give rise to a fairly sudden and sharp drop in tension in one or more ties, as a result of which the uprights connected to these ties in the battery may move and in turn give rise to further leakages, e.g. between the uprights and the refractory structure. It has also appeared that the tension may likewise undergo sudden, sharp increases as a result of which the ties may break.

Temperature measurements taken on the ties in a coke-oven battery have indicated values in the region of 400° C. with major differences in temperature between individual ties. In view of the length of the ties, which may vary from around 12 to 16 meters, these increases in temperature and temperature variations within the ties may result in substantial variations in tension which resilient structures have difficulty in absorbing.

GB No. 667,566 discloses passing cooling fluid through hollow tie rods in a coking oven, while GB No. 428,268 proposes passing air either through the rod or through an annular space around the rod.

DE No. 231,043 describes passing water through a pipe surrounding an oven tie rod.

These cooling methods, though able to provide good cooling of the tie rods, have the disadvantage of requiring means for supply of the coolant, which means may require maintenance and control, and of leading to possible problems of corrosion.

SUMMARY OF THE INVENTION

The object of the invention is to provide a structure which makes the tension in the ties less susceptible to changes in the operating conditions in the coke oven battery and of the individual coking chambers.

The invention consists of providing the pipes through which the tie-bolts run with massive upwardly-extending cooling members for cooling the tie-bolts. It has been found that if the temperature of the ties is reduced by cooling by an average of about 200° C., there is a marked reduction in the differences in tension in the ties recorded with the battery in cold and hot conditions respectively, and in the variations between individual ties. This enables reliable operation to be achieved with considerably less intensive checks on the tension levels of the ties. The ties also become less susceptible to occasional leakages of gas through the oven roof and to flames shooting out of the coke doors. As a result of the reduction in their temperature, the ties also retain their strength to a greater degree, which has been found to result in reduced fracturing in the tie-bolts concerned; this not only represents a saving in cost but also reduces the risk of uprights becoming bent.

In accordance with the invention, preferably a metal block extending approximately to the upper surface of the oven roof is attached to the top of each pipe. The block may be either recessed into the roof or project above it. Typically it may contact the upper metal cladding of the roof. The dimensions of this block can be chosen so that an intense flow of heat takes place from the pipe wall through the oven roof, as a result of which the ties will take up a substantially lesser amount of heat from the pipes.

If the pipe is not adequately cooled by such a metal block, the cooling effect may be further enhanced by the use of an evaporation cooling system, e.g. a hollow block construction in which a chamber in the block is partly filled with a liquid, which is evaporated by the heat from the pipe and is condensed at a cooler region e.g. at or above the upper surface of the roof. The chamber may be partly filled with water, for example, which constantly evaporates in the vicinity of the pipe wall and condenses in the vicinity of the upper surface of the oven roof. The correct dimensions of an evaporation cooling system such as this depend on the conditions in each coke oven battery. An expert will be able to establish these dimensions easily using empirical methods.

It is additionally possible, within the invention, to supply a gaseous coolant under pressure within the pipes.

BRIEF DESCRRIPTION OF THE DRAWINGS

Preferred embodiments of the invention will now be described by way of example with reference to the accompanying diagrammatic drawings, in which.

DESCRIPTION OF THE PREFERRED EMBODIMENTS

Figure 1:
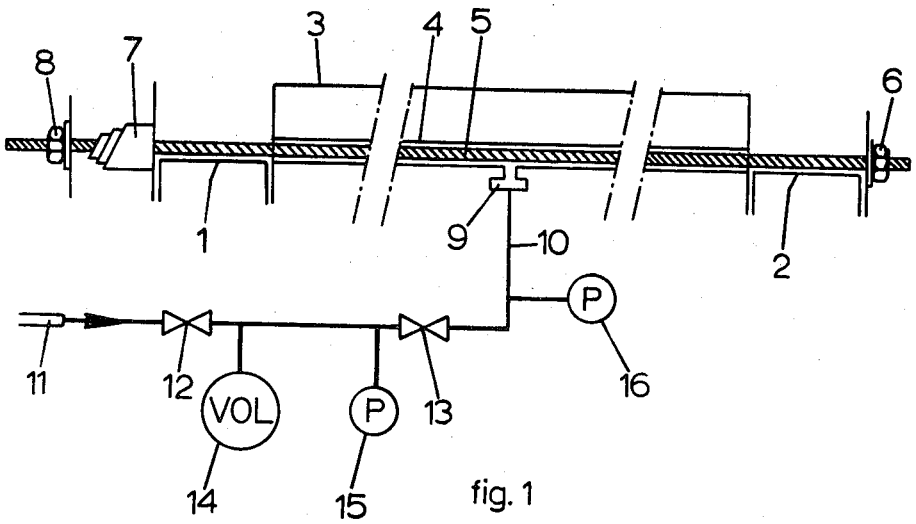
FIG. 1 is a schematic view of a tie-bolt extending across a coke-oven battery embodying the invention.

FIG. 1 illustrates, in outline, the location of a tie-bolt in an oven roof of a coke oven battery. The refractory oven roof 3 extends continuously between uprights 1 and 2 respectively on the pusher side and the coke side of the battery. A plurality of such uprights is present at each side. Pipes 4 (only one of which is drawn) are embedded in the oven roof 3 at a depth of around 100 mm from the top of the roof. A steel tie-bolt 5 passes through each pipe 4, being attached at one end by means of a nut 6 to the upright 2, and at the other end by means of a nut 8 via a spring 7 to the upright 1. By tightening the nut 8 against the spring force of the spring 7, it is possible to adjust the tension in the tie-bolt 5.

Figure 2:
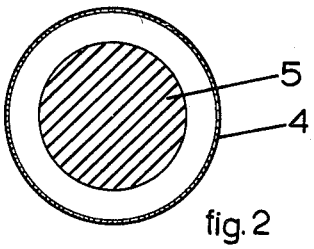
FIG. 2 is a cross-section of the tie-bolts of FIG. 1 in a pipe.

FIG. 2 shows a cross section of the tie-bolt in the pipe 4 on a larger scale. The dimensions of the tie-bolts and the pipes may vary substantially from case to case. The diameter of the tie-bolt in the embodiment illustrated is 52 mm with an external pipe diameter of 76 mm and a pipe thickness of around 3 mm. The width of the gap between the tie-bolt and the pipe in this instance was therefore around 14 mm.

Figure 3:
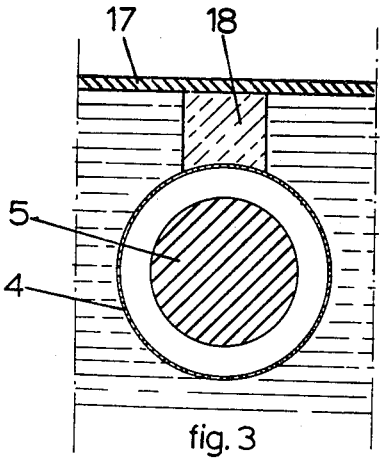
FIG. 3 is a cross-section of the tie-bolt of FIG. 1 showing the oven roof and metal cooling member.

FIG. 3 shows that an elongate metal cooling block 18 is attached to the upper side of the wall of the pipe 4 and extends upwardly into contact with the upper metal cladding 17 of the oven roof 3. The block 18 is sufficiently massive to absorb substantial amounts of heat from the pipe 4 and release it into the atmosphere via the cladding 17. By selection of appropriate dimensions for the block 18, it is possible to cool the pipe 4 in such a way as to keep down the temperature of tie-bolt 5 to a desired extent.

Figure 4:
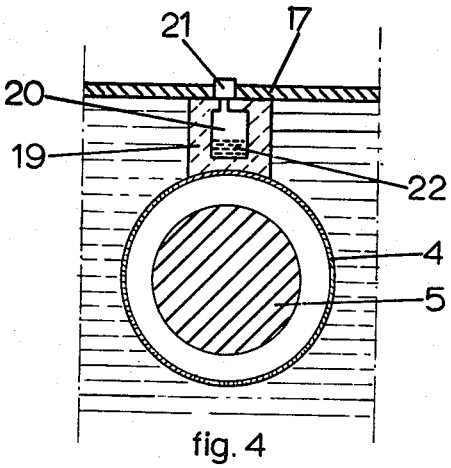
FIG. 4 is a sectional view, similar to that of FIG. 3, showing schematically a variation of the embodiment of FIGS. 1 to 3.

FIG. 4 shows a modified structure of the block 18 of FIG. 3 for cases where a particularly high degree of cooling is required for the pipe 4, in order to keep the temperature of tie-bolt 5 sufficiently low. In this case, the cooling block is a hollow block 19, the cavity 20 of which is partly filled with a liquid 22, e.g. water. This water may be admitted and topped up via a temporary opening 21. A pressure valve may also be fitted at point 21 to keep the pressure within the cavity 20 below a maximum value. During operation, a temperature gradient arises within the block 19 between the pipe 4 and the top of the oven roof. As a result, the liquid evaporates at the bottom of the cavity 20 and condenses at the top of the cavity, and then flows back. This evaporation cooling system effects a vigourous discharge of heat using the heat of evaporation of water.

FIG. 1 shows a duct 10 connected into the pipe 4 via a flange coupling 9 in the middle of the pipe 4. This duct is connected, by means of a stop-cocks 12 and 13, to a compressed-air system 11 having a pressure of 3 bars. By adjusting the stop-cocks 12 and 13 it is possible to regulate the pressure of the compressed air at the entry to the pipe 4 and so control the rate of flow of compressed air. For this purpose, the circuit is fitted with a volumeter 14 and two pressure gauges 15 and 16. The compressed air flows in the pipe 4 in both directions out of the open ends of the pipe 4 and cools the wall of the pipe and the tie-bolts 5.

Although the compressed air flows outwards from the middle of the pipe in both directions in the embodiment illustrated, it is equally possible to envisage a design in which the compressed air is fed in at one end of pipe 4 and discharged at the other. In this way, a yet greater cooling can be achieved.

Many variants are possible of the tie-bolt cooling system principle of the invention.

What is claimed is:

1. Coke oven battery having a pusher side and a coke side;

a continuous oven roof extending between said sides and having an upper side;

a plurality of uprights on each of said pusher and coke sides;

a plurality of ties respectively connecting said uprights on the pusher side with said uprights on the coke side and extending through the oven roof;

a plurality of pipes embedded in said oven roof and housing said ties; and for each said pipe, at least one metal cooling member in contact with said pipe and said upper side of the oven roof, thereby forming a heat transfer path from said pipe to said upper side of the oven roof, said metal cooling member being arranged and constructed to reduce the temperature of an otherwise uncooled tie by an average of around 200° C. during operation of the coke oven battery.

2. Coke oven battery according to claim 1 wherein the upper side of said oven roof comprises a metal cladding, said metal cooling member extending upwardly from said pipe into contact with said metal cladding.

3. Coke oven battery according to one of claims 1 and 2 further having, for each said metal cooling member, an evaporation cooling system comprising a chamber partly filled with liquid, said chamber being at least partly located within said metal cooling member and being so arranged that heat is transferred away from the pipe by evaporation of the liquid in the chamber and its subsequent condensation at a cooler region.

4. Coke oven battery according to one of claims 1 and 2, further having means for supply of gaseous coolant to the interior of said pipes, to cool the ties.

5. In a coke oven battery having a continuous oven roof and a plurality of uprights on each of the pusher side and the coke side, which uprights are connected together by ties extending through the roof in pipes located in the roof, the improvement comprising massive metal cooling members extending upwardly from said pipes, in contact with said pipes and the upper side of the oven roof, and arranged to conduct heat from said pipes upwardly to the upper side of the roof, said metal cooling members being arranged and constructed to reduce the temperature of an otherwise uncooled tie by an average of around 200° C. during operation of the coke oven battery.

6. A coke oven battery according to claim 5 further having evaporation coolers each comprising a chamber partly filled with liquid and located at least partly within said massive metal cooling member.

* * * * *